United States Patent [19]

Mercier et al.

[11] 4,361,744

[45] Nov. 30, 1982

[54] MICROWAVE PROCESS UNIT

[75] Inventors: Gary M. Mercier, Minneapolis; Richard H. Welch, Jr., Princeton, both of Minn.

[73] Assignee: Despatch Industries, Inc., Minneapolis, Minn.

[21] Appl. No.: 223,949

[22] Filed: Jan. 12, 1981

[51] Int. Cl.[3] ..... H05B 6/70

[52] U.S. Cl. ..... 219/10.55 F; 219/10.55 A

[58] Field of Search ..... 219/10.55 F, 10.55 M, 219/10.55 R, 10.55 A

[56] References Cited

U.S. PATENT DOCUMENTS 3,300,615 1/1967 Smith ..... 219/10.55 F 3,492,454 1/1970 Smith ..... 219/10.55 F

FOREIGN PATENT DOCUMENTS 598275 3/1978 U.S.S.R. ..... 219/10.55 F

*Primary Examiner*—Bruce A. Reynolds

*Assistant Examiner*—Philip H. Leung

*Attorney, Agent, or Firm*—James R. Haller; Steven G. Parmelee

[57] ABSTRACT

An improvement in microwave processing units having a turntable disposed with a processing cavity, the improvement comprising tilting the processing cavity and establishing a cross-polarized energy field therein.

4 Claims, 4 Drawing Figures

MICROWAVE PROCESS UNIT

TECHNICAL FIELD

This invention relates generally to microwave processing units that include a processing cavity wherein a product may be placed for processing by exposure to microwave radiation.

BACKGROUND ART

Microwave radiation has been found to have a number of uses, particularly in the areas of communications and as a means of transmitting energy to a product to facilitate processing of that product. The latter application generally involves a unit that provides a processing cavity for receiving the product. Wave guides then direct microwaves from a microwave transmitting source into the processing cavity. In the processing cavity, the microwaves will either be absorbed or reflected, depending upon the various surfaces and materials they come in contact with. Ideally, the product will uniformly absorb all of the radiation. To date, however, this goal has not been met.

The energy field established in the processing cavity by the microwave transmitting source does not have a completely homogenous density. This often results in hot and cold spots and contributes to uneven processing of the product. A number of prior art devices purport to reduce such nonuniformity. In one, the microwave transmitting antenna may be rotated at the exit of the wave guide into the processing cavity. The notion here is to disperse the microwave energy field at different angles. This approach has not fared well, in part because the mechanism operates on an assumption that a beam theory of microwave behavior will adequately describe microwave behavior in a closed cavity. In fact, such a presumption falls short of clearly describing microwave behavior in a close-quartered environment.

Another prior art device known as a mode stirrer provides a grounded metal surface in the processing cavity area. By rotating the mode stirrer, the processing cavity may be tuned to a fairly uniform energy field. To the extent that such devices rotate automatically, however, the mode stirrer may actually detract as much or more as it contributes to uniformity.

Yet another prior art solution to achieve uniformity has been to move the product within the processing cavity during processing. By such movement, the nonuniformities in the energy field would hopefully be averaged out.

Such product movement has generally been accomplished in one of two ways. The product may either be moved up and down, or it may be rotated as on a turntable. The up and down movement may not be successful in improving uniformity, as the energy field may follow such motion and defeat the purpose of moving the product. Rotating the product, however, has been successful. The energy field has somewhat more difficulty in matching rotational movement, and therefore a better averaging of nonuniformity exposure occurs. Even with rotational movement, however, experience has shown that layers of uneven processing can be found in processed products.

Another problem related to uniformity in the area of microwave processing units involves microwave reflections. In particular, if microwave reflections from the processing cavity make their way back to the transmitting source with sufficient energy, the transmitting source will likely be damaged. To protect against this, three port circulators or isolators have been placed in the wave guides to block such reflections. Although expensive, these devices work quite well and do protect the transmitting source from stray reflections.

Reflections may also be reduced by off-loading the processing cavity, to thereby absorb within the processing cavity certain quantities of energy. Unfortunately, off-loading inherently reduces efficiency as it removes energy that might otherwise be usable for processing. The prior art lacks, however, a means of reducing possibly dangerous reflections and at the same time increasing efficiency of the unit.

DISCLOSURE OF INVENTION

The microwave processing unit of the instant invention promotes more uniform processing and also operates to limit further the amount of energy reflected within the cavity. To accomplish these results, the invention provides essentially a two-part solution:

(1) A tilted processing cavity; and (2) Cross-polarized energy fields.

As mentioned above, rotating the product within the processing cavity during processing does encourage uniformity. Unfortunately, layers or rings of uneven processing may still occur. To reduce the possibility of rotating the product through a layer of uneven energy density, the applicants herein have tilted the processing cavity with respect to the plane represented by the turntable surface. By tilting the processing cavity, the product will be passing between the top and bottom of the processing cavity at varying distances as the product revolves on the turntable. Therefore, the exposure of any one part of the product to an area of uneven energy density will be much more random, and the averaging action of the rotational movement will be greatly enhanced.

Randomness may be further increased, and the averaging action therefore made even more effective, by providing an asymmetrical tilted cavity. By providing an asymmetrical cavity, the density of energy will be made purposefully uneven. More particularly, the energy field will be more dense in the less voluminous area of the cavity, and less dense in the more voluminous area of the cavity. By calculatedly creating such an uneven energy field, and by then rotating the product through this field at an angle, uniformity of processing will be further enhanced.

Uniformity can also be enhanced by providing a cross-polarized energy field within the processing cavity. The applicants here have split the propogating energy field from the transmitting source into two separate wave guides by use of a wave guide T intersection. One wave guide enters through the bottom of the processing cavity, and the second wave guide enters through the top. More importantly, however, one of the wave guides will be twisted through 90° with respect to the other wave guide. Consequently, the energy field plane of polarization exiting from one wave guide will be oriented 90° from the energy field emerging from the other wave guide exit. In this sense, the energy field in the cavity will be cross-polarized. Such cross-polarization has been found to enhance uniformity during processing.

The desirable effects of cross-polarization may be further enhanced by spacing the wave guide exit openings such that the combined distance between each opening and the T intersection equals an odd multiple of a quarter wave length. So positioned, the uniformity achieved by cross-polarization will be maximized.

As an additional benefit, the tilted cavity and the spaced wave guides may also contribute to improved efficiency, in the sense that the product itself will generally reflect less energy. In this regard, it should be recalled that even water, which is generally an excellent absorbtion medium for microwaves, will substantially reflect a microwave energy field if the energy field abruptly encounters a perpendicular plane of such a substance. The processing unit of the instant invention attempts to safeguard against such planar encounters with the product during processing by preventing the main energy beam from impinging perpendicular to the product.

The tilting of the processing cavity contributes significantly in this regard. Recalling that the plane of polarization for an energy field cannot be changed relative to the wave guide through which it passes (absent a magnetic field or wave guide bends), and realizing further that the processing cavity will itself operate to a significant degree as a wave guide, it will be appreciated that the energy field's plane of polarization will more gradually encounter the product because of the tilted angle of presentation. Stated another way, the propagation of any segment of the plane of polarization will be more likely to not encounter a product plane at a perpendicular angle (assuming a product of more or less cubic configuration) because the energy field will be encountering the product at a more shallow angle than would normally be expected with a nontilted processing cavity with side or top/bottom straight-in feeds.

Reflection off the product itself can be further minimized by placing the two wave guides of the instant invention adjacent opposite ends of the top and bottom of the processing unit, respectively. By so separating the feeds, the angle of encounter will be made more shallow, reflections will be reduced, and the product will receive impinging energy from all sides.

Other benefits are also realized with the tilted cavity of the instant invention. By placing a drain at the lowest end of the processing cavity, the unit may be more easily cleaned and drained of unwanted liquids. In addition, more room is available for a drive mechanism for the turntable, and servicing this mechanism can be facilitated by easier access thereto.

BRIEF DESCRIPTION OF DRAWINGS

These and other advantages of the instant invention will become more evident upon a study of the following detailed description of the invention that makes reference to the drawings, wherein.

BEST MODE FOR CARRYING OUT THE INVENTION

Figure 1:
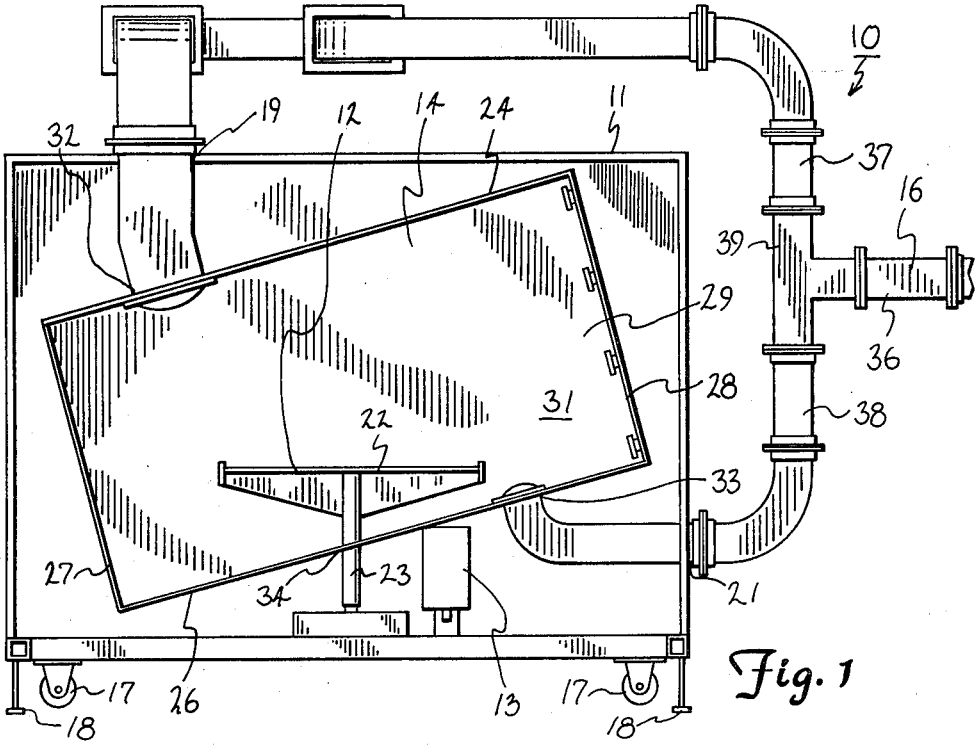
FIG. 1 is a front elevational view of a microwave processing unit having a tilted processing cavity and cross-polarized feeds.

Referring now to the drawings, a best mode for carrying out the invention will now be disclosed. Before reviewing this description, it should be made clear that the instant invention constitutes an improvement in microwave processing units, and therefore much of the technology relating to this unit may be found in the prior art. Such preexisting art need not be described here in detail. In particular, no detailed description will be provided here of microwave transmission sources, wave guide construction with respect to material selection and dimensioning, processing cavity construction with respect to material selection or insulation, control mechanisms for controlling the processing function, turntables and turntable drive mechanisms.

With these admonitions in mind, and referring particularly now to FIG. 1, the apparatus may be seen as depicted generally by the number 10. The apparatus (10) includes a frame (11), a turntable (12) and turntable drive mechanism (13), a processing cavity (14) and a cross-polarized wave guide feed unit (16). These general components will now be described in detail.

The frame (11) comprises essentially a box-like structure made of suitable materials known in the art for housing a processing cavity (14). The frame (11) also has wheels (17) for improved portability and leveling studs (18) for stable operation. Finally, the frame (11) has two openings (19 and 21) for accommodating the wave guide feeds (16) and a door (not shown) on its front for allowing access to the processing cavity (14).

The turntable (12) and turntable drive mechanism (13) may be of any type suitable for this use. They are represented generically here by a generally horizontal turntable platform (22) affixed atop a rotatable axle (23) that connects operably to the turntable drive mechanism (13) that selectively causes the axle (23) and hence the turntable platform (22) to rotate at a desired speed.

Figure 2:
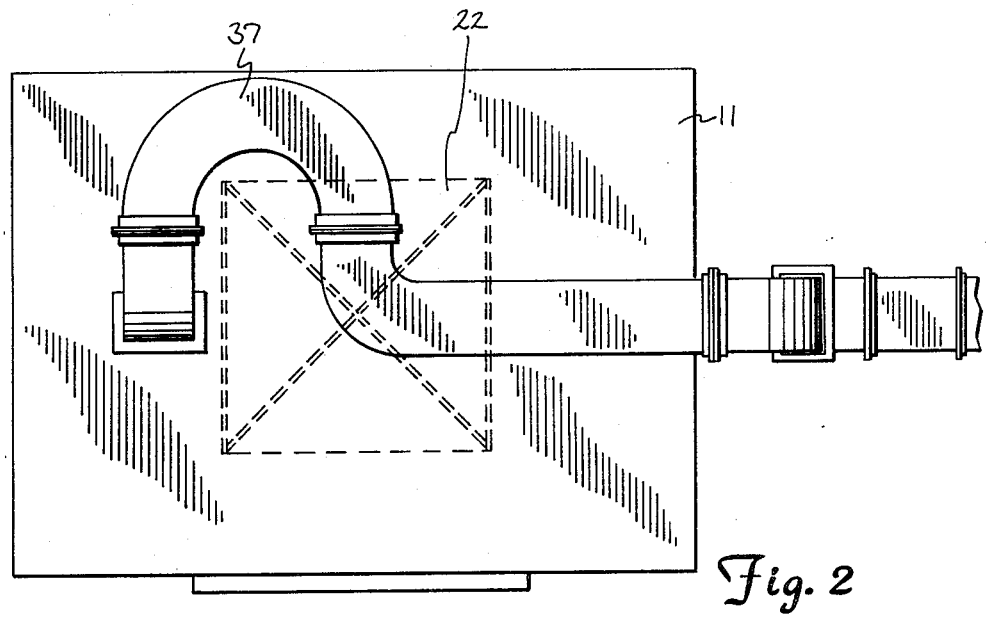
FIG. 2 is a top plan view of the unit as depicted in FIG. 1.
Figure 3:
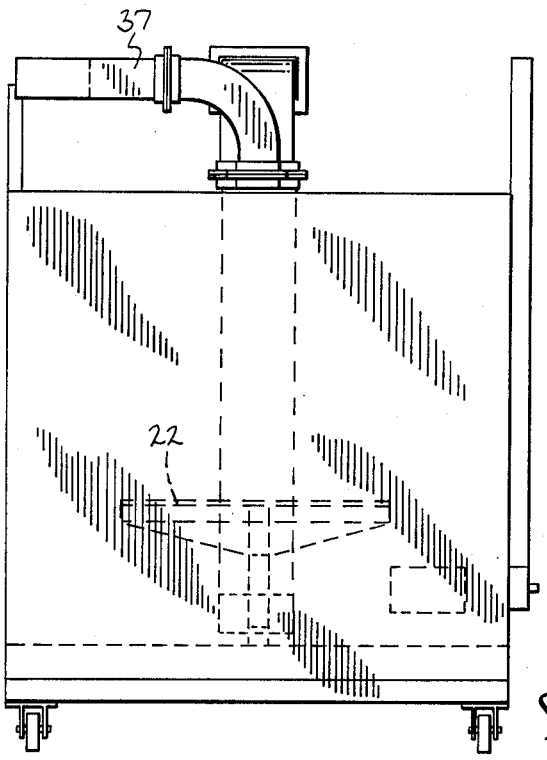
FIG. 3 is a side elevational view of the unit as depicted in FIG. 1.

The processing cavity (14) as depicted in FIGS. 1, 2 and 3 comprises a structure made of typical materials and of typical dimension, but being positioned within the frame (11) at an angle to the turntable platform (22). As shown, the top (24) of the processing cavity (14) is parallel with the bottom (26), the sides (27 and 28) are parallel with one another, and the back (29) is parallel with the plane of the front opening (31). That is, the top (24) and the bottom (26) are tilted with respect to the horizontal; they are non-horizontal. Finally, the top (24) and bottom (26) each include an opening (32 and 33) adjacent their respective opposed ends to receive the wave guide feeds (16), and the bottom (26) includes an additional opening (34) for receiving the turntable axle (23).

The cross-polarized wave guide feed unit (16) includes a main transmission guide (36), an upper feed (37) and a lower feed (38). The main transmission guide (36) has one end connected to the transmission source (not shown) and the remaining end connected to a field splitting "T" intersection (39). One branch of the "T" (39) forms the upper feed (37) and the other branch forms the lower feed (38).

As shown in FIG. 1, the lower feed (38) angles downwardly below the processing cavity (14) and connects to the opening (33) provided therein. The upper feed (37) angles upwardly above the processing cavity (14) and connects to the opening (32) provided therein.

As perhaps best shown in FIG. 2, however, the upper feed (37) also arcs through 180° so that the feed (37) enters the processing cavity (14) at a 90° angle to the lower feed (38). In addition (referring again to FIG. 1), the openings in the top (32) and bottom (33) of the processing cavity (14) are situated such that the combined distance from the top feed opening (32) to the "T" intersection (39) and the distance from the bottom feed opening (33) to the "T" intersection equals an odd multiple of one-quarter wave length of the microwave frequency to be used in the apparatus (10). By this arrangement, the energy field introduced into the processing cavity (14) by the upper and lower feeds (37 and 38) will be cross-polarized.

In addition, it may be observed that the upper and lower feeds (37 and 38) are positioned at distal ends of the processing cavity (14), to promote a more shallow angle of encounter between the energy field and the product.

Figure 4:
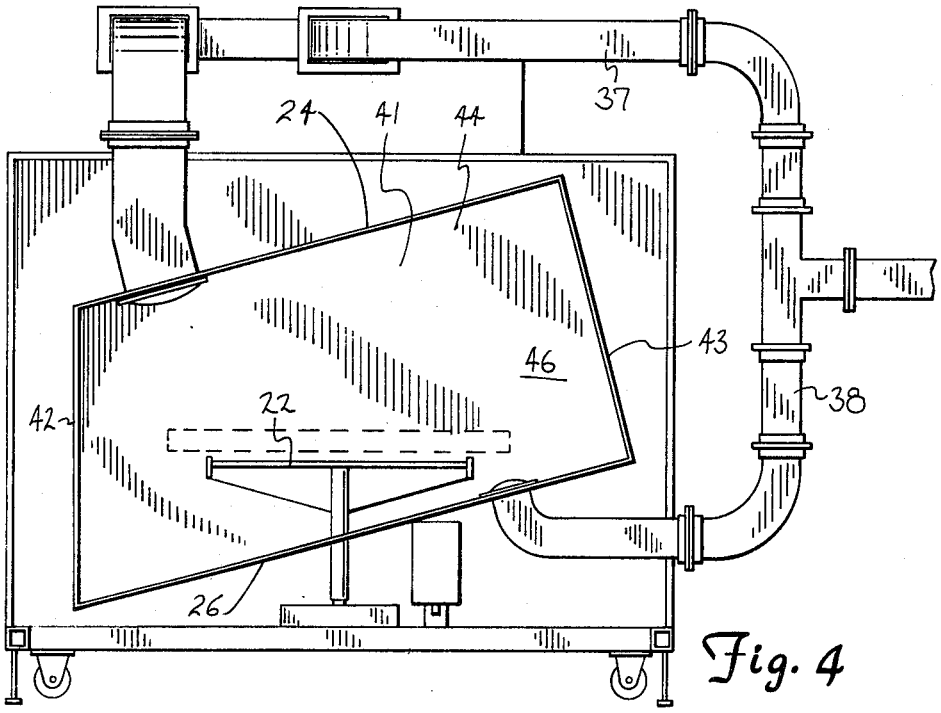
FIG. 4 is a front elevational view of a microwave processing unit having a tilted asymmetrical processing cavity.

Referring now to FIG. 4, it may be seen that the processing cavity (41) may be made asymmetrical as well as tilted with respect to the turntable platform (22). In general, such an asymmetrical cavity (41) should have areas of varying boundary conditions such that the energy field, when introduced through the upper and lower feeds (37 and 38), will of necessity be of varying densities throughout the processing cavity (41). In the embodiment depicted, the sides (42 and 43) of the processing cavity (41) are no longer parallel, and the back (44) is no longer parallel with the plane of the front (46). As shown, the top (24) and bottom (26) are tilted with respect to the horizontal.

As noted above, the tilted processing cavity (14), and in particular the asymmetrical tilted cavity (41), distinctly enhance both the uniformity of processing (when used in conjunction with a turntable (12)) and in reducing reflections off of the product being processed. Similarly, the distally mounted cross-polarized wave guide feeds (37 and 38) enhance the uniformity of processing and also reduce reflections off of the product.

Obviously, many improvements could be made upon the disclosed invention without departing from the spirit thereof. For instance, the degree of tilting or the nature of the asymmetry could be any workable design other than those specifically depicted herein. Such variations should be considered a part of the invention and would specifically be related to the geometry of the product.

What is claimed is:

1. A microwave processing unit comprising a processing cavity having a top and bottom tilted with respect to the horizontal and a generally horizontal turntable platform rotatably disposed therewithin the unit including first wave guide feed means positioned on the top of said processing cavity adjacent one end thereof, and second wave guide means positioned on the bottom of said processing cavity adjacent the other end thereof.

2. The unit of claim 1 wherein said processing cavity is asymmetrical in shape.

3. A microwave processing unit comprising a processing cavity having a top and bottom tilted with respect to the horizontal, a generally horizontal turntable platform rotatably disposed therewithin, and (a) first wave guide feed means positioned at the top of said processing cavity adjacent one end thereof; and (b) second wave guide feed means positioned at the bottom of said processing cavity adjacent the other end thereof, said second wave guide feed means being positioned at a 90° angle with respect to the said first wave guide feed means such that microwave radiation entering said processing cavity through said first and second wave guide feed means will establish a substantially cross-polarized energy field within said processing cavity.

4. The unit of claim 1 or claim 3 wherein said first and second wave guide feed means each include:

(a) a first end operably connected to a "T" intersection wave guide; and (b) a second end operably connected to the processing cavity, such that the combined distance between the first end and the second end of said first wave guide feed means and the distance between the first end and the second end of said second wave guide feed means equal an odd multiple of a one-quarter microwave wave length as used in said processing cavity.

* * * * *